US011184956B2

(12) United States Patent
Jussel et al.

(10) Patent No.: US 11,184,956 B2
(45) **Date of Patent: *Nov. 23, 2021**

(54) DENTAL FURNACE AND PROCESS FOR OPERATING A DENTAL FURNACE

(71) Applicant: Ivoclar Vivadent AG, Schaan (LI)

(72) Inventors: Rudolf Jussel, Feldkirch (AT); Manuel Schlegel, Mels (CH)

(73) Assignee: Ivoclar Vivadent AG, Schaan (LI)

( * ) Notice: Subject to any disclaimer, the term of this patent is extended or adjusted under 35 U.S.C. 154(b) by 410 days.

This patent is subject to a terminal disclaimer.

(21) Appl. No.: 16/182,662

(22) Filed: Nov. 7, 2018

(65) Prior Publication Data

US 2019/0150227 A1 May 16, 2019

(30) Foreign Application Priority Data

Nov. 10, 2017 (EP) ..... 17201096

(51) Int. Cl.

| | |
|---|---|
| ***H05B 3/12*** | (2006.01) |
| ***F27B 17/02*** | (2006.01) |
| ***F27D 11/02*** | (2006.01) |
| ***H05B 6/12*** | (2006.01) |
| ***F27D 9/00*** | (2006.01) |

(Continued)

(52) U.S. Cl.

CPC ..... *H05B 3/12* (2013.01); *F27B 5/14* (2013.01); *F27B 17/025* (2013.01); *F27D 9/00* (2013.01); *F27D 11/02* (2013.01); *H05B 3/64* (2013.01); *H05B 6/129* (2013.01); *F27B 2005/143* (2013.01); *F27D 2009/0051* (2013.01); *H05B 2203/018* (2013.01)

(58) Field of Classification Search

CPC . H05B 3/12; H05B 3/64; H05B 6/129; H05B 2203/018; F27D 9/00; F27D 11/02; F27D 2009/0051; F27B 5/14; F27B 17/025; F27B 2005/143

See application file for complete search history.

(56) References Cited

U.S. PATENT DOCUMENTS

| | | | |
|---|---|---|---|
| 4,267,435 | A | 5/1981 | Best |
| 6,008,477 | A | 12/1999 | Nakao et al. |

(Continued)

OTHER PUBLICATIONS

Aegis Communications et al., "Hot Alone Will Not Do The Trick! | IDS | aegisdentalnetwork.com," Inside Dental Technology, Jan. 2, 2017 (Jan. 2, 2017), vol. 8, Issue 1, www.aegisdentalnetwork.com/idt/2017/hot-alone-will-not-do-the-trick.

*Primary Examiner* — Shawntina T Fuqua
(74) *Attorney, Agent, or Firm* — Ann M. Knab; Thad McMurray

(57) ABSTRACT

The invention relates to a dental furnace, in particular a high-temperature dental furnace for oxide ceramics such as zirconium dioxide having sintering temperatures of between 1300 and 1850° C., comprising a heating element (10) which is intended to give off heating energy to the firing chamber. It is provided that the heating element (10) comprises at least two heating element sections (48, 50) adjoining one another at a transition area (34) which is not current-carrying and/or which extends away laterally, that the transition area (34) is supported on a position, in particular on the free end, spaced apart from the electrical connections (16, 18) on the dental furnace and carries at least the two adjoining parts of heating element sections (48, 50).

21 Claims, 12 Drawing Sheets

(51) Int. Cl.
*F27B 5/14* (2006.01)
*H05B 3/64* (2006.01)

(56) References Cited

U.S. PATENT DOCUMENTS

2018/0051931 A1 2/2018 Fornoff et al.
2019/0316843 A1* 10/2019 Schlegel ..... F27B 17/025

* cited by examiner

DENTAL FURNACE AND PROCESS FOR OPERATING A DENTAL FURNACE

CROSS-REFERENCE TO RELATED APPLICATIONS

This application claims priority to European patent application No. 17201096.9 filed on Nov. 10, 2017, the disclosure of which is incorporated herein by reference in its entirety.

FIELD OF THE INVENTION

The invention describes a dental furnace, in particular a high-temperature dental furnace as well as a process for operating a dental furnace.

BACKGROUND

For dental furnaces of this type, heating elements of different provenance are used. When they are realized as resistance heating elements, but also in case of induction furnaces, the electrical conductivity and the corresponding dimensioning as well as the installation of the heating element is crucial for a long-lasting use at the required high furnace temperatures.

Of course, it is also important that the heating element comprises sufficient mechanical strength. Depending on the material used in each case the transition of the material properties of the heating element from strong to ductile is in a temperature range that is clearly below the melting temperature.

The distance of the transition temperature to the melting temperature can amount to several 100° C., by all means. Thus, the maximum application temperature for molybdenum disilicide ($MoSi_2$) is 1850° C., while the transition temperature range already starts with 1200° C. and extends to 1850° C.

In many cases, however, there is only unsafe data on this such that manufacturers of heating elements recommend working with a corresponding safety margin.

Furthermore, in case of directly electrically heated $MoSi_2$ heating elements, the materials used for the electrical connection are frequently less temperature-resistant than the heating element itself. In order to realize a drop in temperature in the connection region it has thus been recommended to implement the heating element adjacent to the connections with a larger strength and corresponding length such that the conductivity per unit of length is larger thereat and thus the emitted heat output smaller.

In order to be able to work safely also in the ductile temperature range of heating elements, i.e. above 1200° C., it has been suggested furthermore to install the heating elements in a hanging fashion, that is to say such that the electrical connections are disposed at the top and such that in spite of the tare weight of the heating element it does not tear apart due to its cohesion in spite of a ductile state.

Up to a certain extent, this process may be realized in this way, wherein care must be taken to not cause mechanical vibrations of the ductile heating element during the heating mode.

Here, the clearly defined arrangement of the connection site at the top is unfavorable. The air surrounding the heating element rises such that in this way the connections at the top are heated. In addition, in many cases the power electronics of furnaces is disposed at the bottom, that is to say in the furnace base, such that in this respect, too, it is unfavorable to shift the connections to the top. It would also be advantageous, to keep the connections to the power electronics short with regard to the high electric heating currents. Depending on the configuration and dimensioning, currents of 100A and more are possible.

A serious limitation when using a heating element made of the metal-ceramic material molybdenum disilicide ($MoSi_2$) is, however, that the $SiO_2$ layer protecting the heating element and giving good oxidation resistance for use up to the maximum temperature of up to 1850° C. to the heating element must not be damaged or removed. This protective layer protects the base material against extreme oxidation and contamination or corrosion, respectively. However, particularly contaminants that get to this $SiO_2$ protective layer, for instance, through contact with the thermal insulation may also react with this $SiO_2$ layer and lower its melting point, or simply mechanically remove this then softened layer at high temperatures. In the end, this will again lead to exposure of the base material.

Then, the consequences are a possibly reduced service life of the heating element although the protective layer will be regenerated normally if sufficient oxygen is present. However, even more disadvantageous is a yellow/green discoloration of dental $ZrO_2$ restorations that are to be sintered. This discoloration leads to a loss and uselessness of the dental object.

When using $MoSi_2$ material as a susceptor for an induction heating it is unavoidable to support the heating element, and thus this means a limitation of the maximum furnace temperature with no further action taken.

In order to reduce these problems in case of electrically directly heated $MoSi_2$ heating elements other types of heating elements have also been suggested. Thus, mechanical fastening elements have become known which are intended to protect the heating element against deformation at high temperatures. However, in this case, the fastening elements are in loose but direct contact with the heating elements, which limits the maximum element temperature to, for instance, 1600° C. The furnace temperature will then be considerably lower, depending on the heating rate and the dimensioning of the firing chamber.

Further, there is a danger that the micro movements which increase particularly with very high heating rates damage the protective oxide layer in this contact region from the heating element to the fastening element, which may lead to a loss of the heating element, and insofar the protective surface layer made of $SiO_2$ is crucial for the stability of the heating element made of $MoSi_2$.

The installation of these fastening elements that are usually also made of $MoSi_2$ material is often unfavorable and carries costs.

In summary, the maximum application temperature as well as the maximum heating rate are limited.

In case of dental furnaces which use respective heating elements it is further crucial to maintain the protective oxide layer and to prevent molybdenum from steaming out of the heating element, as this would lead to the unsightly yellow/green discoloration of the dental restoration which has already been mentioned.

To prevent this from happening it has become known to carry out firing processes which are referred to as regeneration firing processes in which no dental restoration parts are placed in the dental furnaces and in which the $SiO_2$ layer is regenerated. This will happen when sufficient oxygen and high temperatures are present through oxidation of Si from the $MoSi_2$ heating element.

A further problem is uncontrolled flaking of the $SiO_2$ layer. The layer is formed by oxidation and is much more brittle than $MoSi_2$. At those positions at which the oxide layer flakes, the heating element is weakened mechanically, at least until a new oxide layer is formed. Flaking takes place due to the different coefficients of thermal expansion of $MoSi_2$ and $SiO_2$ in case of a certain layer thickness, wherein the structure of the layers itself in turn depends on numerous parameters, but in particular on the temperature of the heating element at the place regarded respectively. Heating elements that have very thin $SiO_2$ layers are preferred.

On the other hand, an increase in temperature requires a stronger possible oxidation process such that, in this respect, two effects affect the efficiency of the heating element: on the one hand the softening of the material due to the increase in temperature, and on the other hand the oxidation process and the associated higher likelihood of a flaking of the oxidation layer. This effect becomes more likely with increasing heating rates.

SUMMARY

In contrast, the invention is based on the task of providing a dental furnace well as a process for operating a dental furnace which allows for improved temperature stability of the used heating element. This task is inventively solved by the claims and subclaims.

The invention is characterized by particularly constructed transition areas between sections of the heating element. The transition areas are firmly connected with the heating element, but extend away from its longitudinal extension. Thus, the current heating the heating element does not flow through the transition areas, that is to say they are not actively heated by the heating current. The transition areas, or rather their respective support sections, are supported themselves inventively, namely at a position spaced apart from the adjoining heating element sections, or at least at this position.

By means of the support in the furnace surroundings the transition areas are cooled already, and in this respect they can also be called "cold ends". At the same time, this cooling process also causes cooling of the adjoining heating element sections to a certain extent. Preferably, the transition areas consist of the same metallic material as the heating elements apart from that. In this way, the temperature of the heating element—as viewed along its length—is reduced automatically repeatedly such that short, relatively hot sections adjoin short, relatively cold sections.

This leads to a substantially improved stability of the heating element or rather the protective $SiO_2$ glass layer, particularly in those areas on which this heating element rests, that is to say where it is supported by the support sections.

The connection between the transition area and the heating element, that is to say the adjoining heating element sections of the heating element, may be effected in any desired way. It is preferably carried out by welding, wherein, for instance, molybdenum disilicide is easily weldable after a possible oxide layer has been removed.

According to the invention, in this respect, the heating element is supported by several, at least two or, depending on the length of the heating element, by up to 10, for example, cold ends or transition areas along its extension.

At least partially, no heating current flows through the transition areas. Particularly, when the heating element is realized as an inductive heating element, parts of the welded on transition area in the region of the welded joint may carry a current along a short distance.

However, there are always free ends of the transition areas. They serve to rest on a support region. Here, the support region is any desired part of the dental furnace, for instance its thermal insulation, which serves to support the heating element.

A recess may be provided, for instance, in the thermal insulation of the dental furnace for every transition area, and said recess may then carry the free end of the transition area.

The support section of the transition area extends away to the side such that it ends in a free end. In this respect, said extension may be realized to the top, to the bottom, horizontally or transversely.

Then, the free end is accommodated in the recess, which carries it, with clearance. Thus, the recess in the thermal insulation is preferably considerably larger than the free end of the transition area, both radially and axially.

The clearance desired in this respect takes into consideration the thermal expansion of the heating element.

At least a large part of the transition areas and their associated support sections does not carry a current. Thus, no drop in voltage and consequently no heating arises thereat. Rather, every support section is then surrounded by air which is colder than the temperature of the heating element. It cools the support section and thus the transition area. In this way, the associated welded joints of the transition area are cooled, too, and thus in turn the adjoining heating element sections.

According to the invention, it is also favorable that no stiffness discontinuities are present through the indirect cooling of the adjacent heating element sections when the heating element is heated in an admissible range. In the region of abrupt changes in cross-section, that is to say for instance at the welded joints, the material of the heating element is cooled to such an extent that it is solid and not ductile anymore, in any case. Starting from this contact point between the transition area and the adjoining heating element sections the temperature increases into the ductile region. There, the heating element sections extend with a consistent cross-section, as is typical for heating elements of this type.

Preferably, the cross-section is larger at positions at which electrical connections are provided. In a way known per se, this reduces the ohmic resistance of the heating element and thus the temperature at this position.

The invention is particularly advantageous when compared to a mechanical support of the heating element along its extension in a way known per se, as is known, for instance, from FIG. 8 of DE 31 13 347 C2. Due to the thermal expansion of the heating element, a micro movement occurs thereat between mechanical supports of this type and the heating element, said micro movement damaging the surface of the heating element such that oxide layers may flake uncontrolledly. This may lead to a complete destruction of the heating element, particularly when a $MoSi_2$ heating element is used.

When $SiO_2$ has been oxidized, pure metallic molybdenum is left which has a melting point at approximately 700° C. and is not temperature resistant in any way, in this respect.

According to the invention, it is also favorable that the electrical connections may be shifted to the bottom cooler region of the firing chamber without further ado. There, they typically adjoin the power electronics.

According to the invention, very fast heating temperature gradients of up to 300° C. per minute or more, depending on the available power and size of the firing chamber, may be realized using the heating elements as described herein. Due to the inventively particular support, the heating element may have a comparatively low mass which allows for a large temperature gradient.

An inventive heating element may have the shape of a meander in any desired fashion or may also extend in a substantially linear fashion. Here, meander-shaped is to be understood as an alternating support at the bottom and top. The heating element may also be only supported at the top such that the transition areas are provided only at the top and heating element loops hang from there to the bottom.

In case of a support at the bottom it is also possible to configure the support at the top in such a way that only lateral tilting of the respective heating element loop is avoided.

According to the invention, contact between the actively heated heating element areas, the current-carrying heating element sections, and the thermal insulation may be avoided. Thus, any relative movement of the non-heated and cooler fastening parts does not lead to abrasion of a protective oxide layer or corrosion by lowering the melting temperature.

Preferably, the connection between the transition area and the heating element sections is metallic. In any case, it is strong to such an extent that a mechanical movement between the transition area and the heating element section is not possible.

In a preferable configuration, the transition area is configured as one piece with the heating element.

In an advantageous configuration, the cold end of the transition area may also be cooled purposefully in order to accelerate the heat dissipation from the firing chamber, if necessary.

According to the invention, it is also favorable that less compression stress develops in the heating element by means of the cooler heating element sections which adjoin the transition areas during fast cooling of the heating element, for instance, in case of an open furnace. The compression stress may not build up along the entire heating element in its full longitudinal extension, but only in the short sagging sections of the heating element.

According to the invention, the $MoSi_2$ heating element which is heated to a maximum temperature of 1850° C. heats the interior of the furnace to 1800° C. in a stable fashion, namely with a rapid heating rate and, if necessary, also a rapid cooling rate per unit of time. The heating rate and the achievable maximum temperature of the furnace are limited by the element temperature developing at the heating element, said element temperature being larger than the temperature of the furnace in any case.

It is advantageous that the heating element consists of molybdenum disilicide or at least comprises molybdenum disilicide. Then, the dental furnace can heat the molybdenum disilicide to a temperature at which the mechanical tensile strength is reduced to less than half of the respective room temperature, in particular to less than 100 MPa at a temperature of 1600° C. Still the heating element maintains stability due to the more brittle and thus stronger oxide layer in the cooler support region.

In any case, the dental furnace will heat the heating element to a temperature at which the strength of the oxide layer surrounding the heating element is larger than that of the core of the heating element. The maximum furnace temperature may amount to, for instance, 1800° C. at a heating element temperature of 1850° C.

Preferably, a support region for the metal element of the transition area is provided in the thermal insulation. This is where its cold end is supported. Heating element sections are provided adjoining the transition area. The largest temperature gradient in the heating element as viewed along its extension is present adjacent to the transition area.

It is preferable that the thermal insulation through which the heating element passes consists of or comprises aluminum silicate fibers.

It is advantageous that at least the cold end of the transition area, or the entire transition area, which may also be referred to as support section of the heating element does not carry the heating current and that the heating element is cooled section by section by the surroundings of the support section, in particular the thermal insulation, which is contacted by the support section.

It is favorable that the heating element is configured as a circular pipe or comprises a circular pipe.

Furthermore, it is advantageous that the heating element is configured in a partially bent fashion and that bends of the heating element are configured in the bottommost region, while straight regions of the heating element extend above the bends. Then, the heating element is hanging and has the largest possible dimensional stability for this reason.

In a modified configuration, it is provided that the heating element is configured as an induction heating element and that support sections which do not carry a current support the heating element and keep it in metallic contact, particularly integrally, with current-carrying heating element sections.

It is also good if the transition areas are cooled at their free ends, that is to say particularly on this side of the thermal insulation, in particular by means of an active cooling process.

In this respect, it is inventively favorable that the heating element sections adjoin one another or are connected with one another by transition areas or support sections which at least partially do not carry a current and support the heating element which extends downwards—relative to its electrical connections—along its extension.

Comparative tests have shown that in case of conventional dental furnaces with the same heating profile and the same choice of material for the heating element in many cases a fast failure of the heating element or the particularly unfavorable discoloration of dental restorations occurs, even if regeneration firing processes have been carried out.

In an inventive process for operating a dental furnace the heating element consists of molybdenum disilicide or comprises more than 50% of molybdenum disilicide. The surface of the heating element is oxidized by heating.

Dental ceramics are fired and sintered at temperatures of 1300° C. to 1800° C.

Typically, the oxide layer exhibits higher strength than the metallic core of the heating element at high temperatures of 1300° C. to 1850° C.

The oxidation process increases with higher temperatures. This leads to the formation of an oxide layer whose thickness is temperature-dependent, that is to say it is thicker at hotter places of the heating element and thinner at colder places.

Thicker oxide layers tend to flake easily. Thus, the heating element is preferably checked regularly in this respect.

If necessary, it is subjected to regeneration firing. In this firing process, the dental furnace is brought to an oxidation temperature of the molybdenum disilicide, however, without the placement of dental restoration parts. This ensures a uniform thickness of the oxide layer.

BRIEF DESCRIPTION OF THE DRAWINGS

Further advantages, details and features may be taken from the following description of several exemplary embodiments of the invention in conjunction with the drawings.

DETAILED DESCRIPTION

Figure 1:
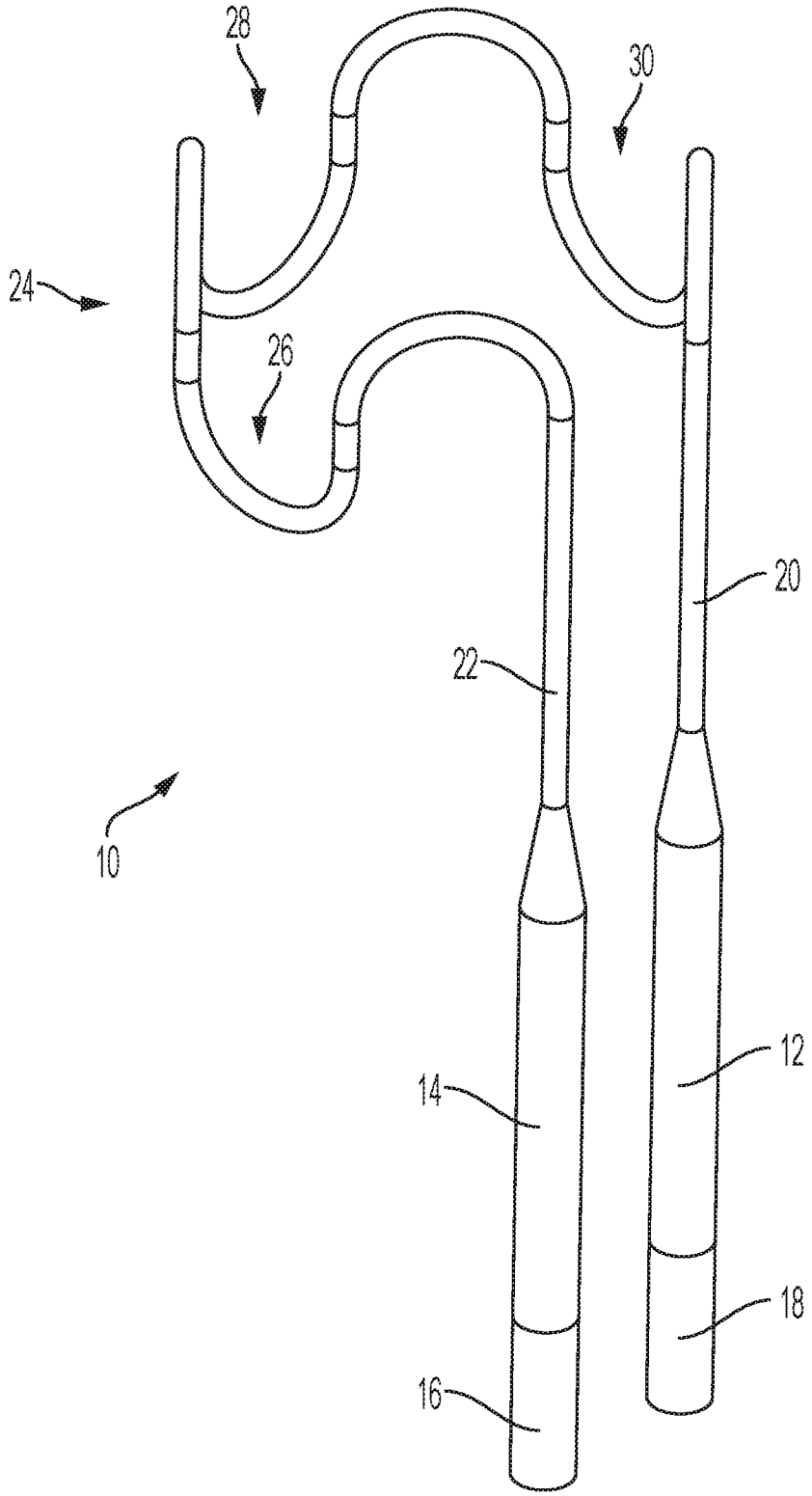
Fig. 1 PRIOR ART
FIG. 1 shows a schematic perspective illustration of a prior art known dental furnace, namely of the heating element.

FIG. 1 shows a prior art heating element arrangement 10 as part of an inventive furnace, in particular dental furnace, wherein the heating element comprises thickened regions 12, 14. At the lower end of the thickened regions are electrical connections 16, 18.

The heating element 10 extends from the thickened regions to the top and comprises vertical legs 20, 22. It is disposed in a circular fashion in the actual heating area 24—as viewed in the top view—and surrounds a firing chamber, which is not illustrated. It is received in a thermal insulation in an annular recess which is open towards the inside. There, the heating element 10 is supported on its bottom end, namely on three positions in contact with the insulation in the embodiment illustrated. For this purpose, the heating element is virtually configured in the shape of a meander such that three heating element loops which are open towards the top and three heating element loops which are open towards the bottom are formed. The heating element loops 26, 28 and 30 which are open towards the top are rounded at the bottom, and the heating element is supported in the heating area 24 thereat.

The support at this position has the disadvantage that mechanical contact between the hot heating element at this position and the comparatively cooler thermal insulation is realized. Additionally, the heating element expands due to the heating such that a relative movement between the thermal insulation and the heating element occurs. The $SiO_2$ layer is damaged and a possible discoloration of the dental restoration is the result. Without this contact, the mechanical strength of the heating element is not sufficient at too high temperatures, and consequently this will lead to deformation and in the end to contact with the thermal insulation surrounding the heating element nevertheless.

Figure 2A:
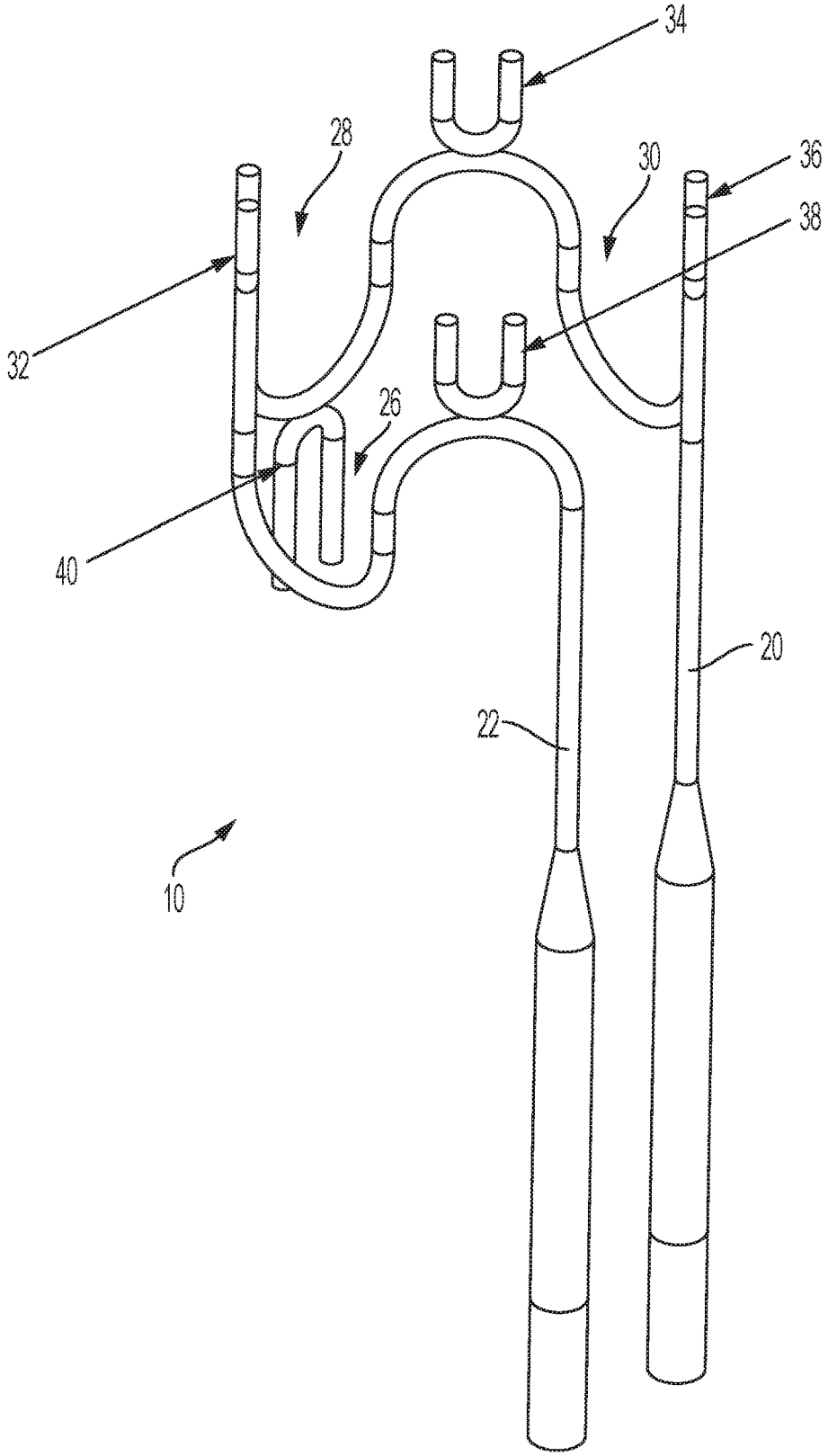
FIG. 2*a* shows a perspective view of an inventive embodiment of the heating element.

The invention avoids these disadvantages of the prior art. For this purpose, in the embodiment according to FIG. 2*a*, heating element arrangement 10 includes a configuration of current-carrying elements 11 which includes transition areas 34, 36, 38 and 40. The transition areas comprise metallic elements which are intensively connected with the heating element 10, in particular by welding. In the heating area 24, the metallic elements which may also be referred to as support sections extend away from the heating element laterally as viewed along its extension, respectively.

Here, the support section refers to the metallic element which extends away transversely to the main direction of extension of the heating element 10. It forms the transition area together with the welded joint or any other metallic connection with the adjacent heating sections. Every transition area adjoins two heating sections, as is obvious from the figures.

Figure 11:
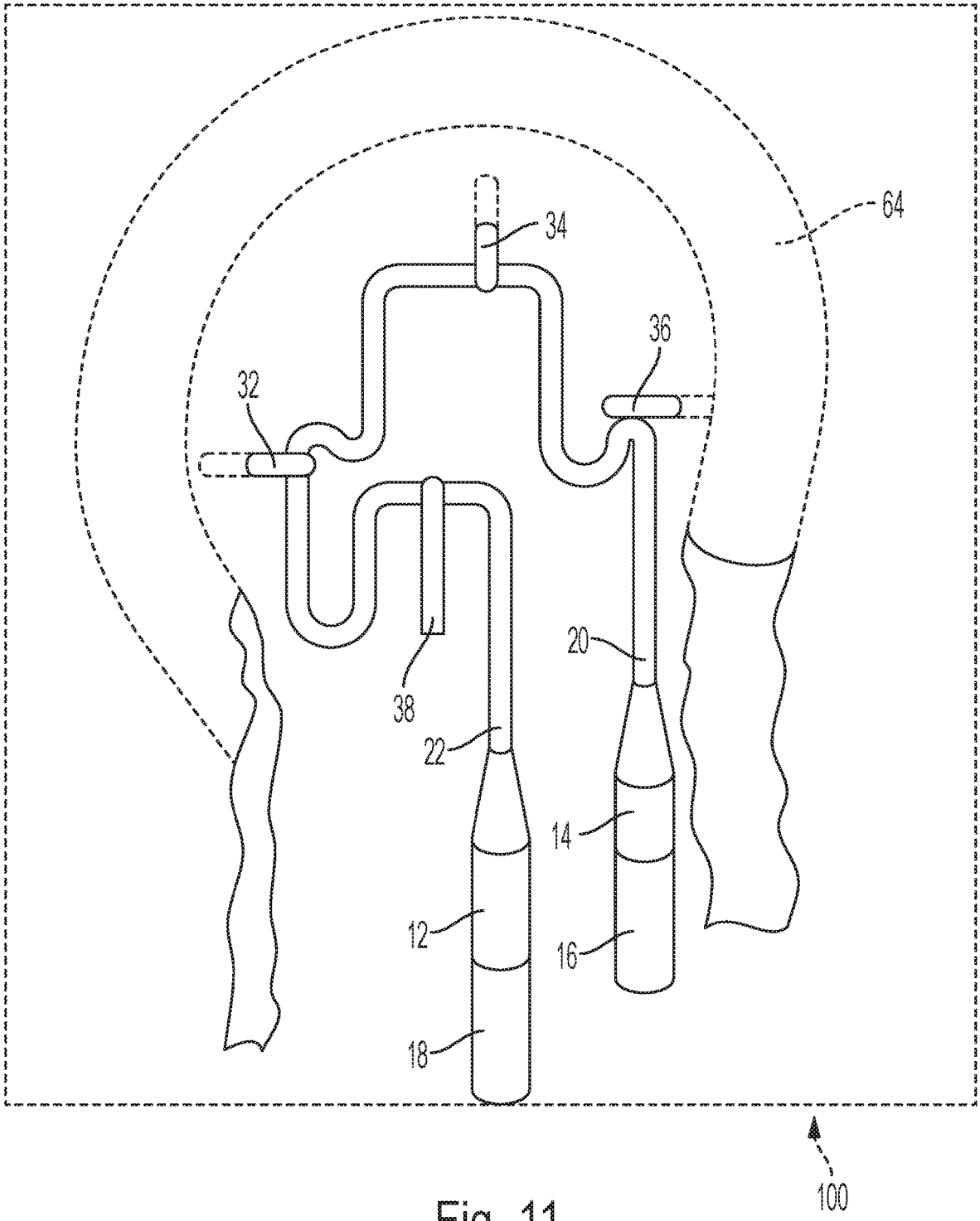
FIG. 11 shows a further embodiment of an inventive heating element.

In the first embodiment of the invention illustrated herein the free ends of the transition areas and naturally their associated support sections extend into recesses of the thermal insulation 64 of furnace 100, which is illustrated in FIG. 11. They are supported thereat, namely vertically with respect to the metal element or support section 40 extending downwards, and laterally with respect to the metal elements or support sections 32 to 38 extending upwards.

In this configuration, the heating element 10 is carried by the free end 42 of the support section 40 and the vertical legs 20 and 22 of the heating element. They are disposed diametrically opposed to one another with regard to the circle of the heating element.

In this embodiment, the support sections 32 to 40 are configured as U-shaped arches whose center leg is welded to the heating element. Then, the open end of the U-shaped arch extends away from the open end of the adjacent heating element loops 26 to 30, respectively. Although shown as U-shaped, the support sections may be any shape including but not limited to U-shaped, T-shaped, L-shaped, bar-shaped, rod-shaped, closed or open circular, closed or open oval, closed or open square, closed or open rectangular, and the like.

It is preferable that the support sections are fabricated of, but not limited to, metal, metal alloys, ceramic materials, metal-ceramic materials (eg., MoSi) and the like.

Regions of the heating element adjacent to the transition area, which are referred to as heating element sections herein, are cooled by it and thus stabilized. While the entire heating element 10 carries current, at least the free ends 42 of the transition area 30 to 40 considered respectively, or rather of the respective metal element, are free and no heating current flows through them. This means that they are automatically cooler.

Figure 2B:
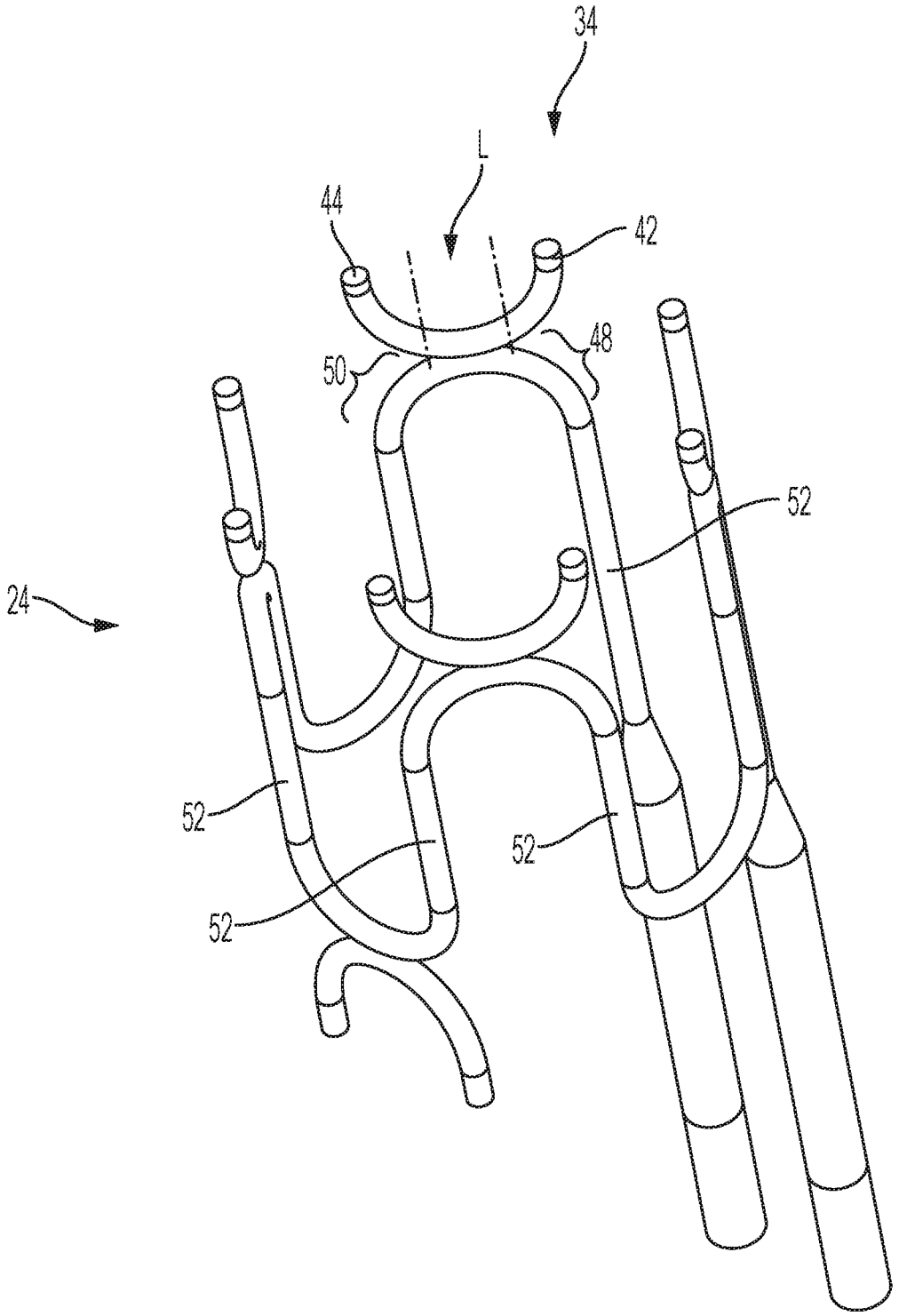
FIG. 2*b* shows a changed embodiment of the inventive heating element, also in a perspective implementation.

This can be considered more closely with respect to FIG. 2*b*.

FIG. 2*b* shows a further configuration of an inventive heating element 10. Here, just like in the further figures, the same or respective parts are provided with the same reference numerals.

Here, the metal element 34 is also configured in the shape of a U, but with a width of the arch corresponding to the width of the heating element loops provided in each case. It is welded to the heating element 10 along a length L. Starting from this point, two free ends 42 and 44 of the support section 34 extend away from the heating element 10, to the top in the support section illustrated, as the heating element 10 extends to the bottom starting from the length L in a curved fashion.

The support section 34 is in intensive metallic contact with the heating element 10 along the length L. Heating element sections 48 and 50 adjoin this contact area. They are not in contact with the support section 34.

Due to the cooling effect of the support section 34 along the length L, the temperature at the transition between the heating element section 48 or rather the heating element section 50 and the section L is relatively low, for instance 1200 or 1300° C. It increases along the heating element section 48 or 50 starting therefrom, as electric current flows through the heating element 10 uniformly. The temperature reaches its maximum value of 1850° C. in the vertical legs 52 of the heating element 10. The inventive heating element withstands this temperature as it consists of $MoSi_2$.

Accordingly, with this solution, the hot and ductile area between the upper and lower heating element sections is comparatively short in the entire heating area 24, which is for the benefit of mechanical stability, such that the heating element can be operated up to the limits of the ductile range.

Figure 3A:
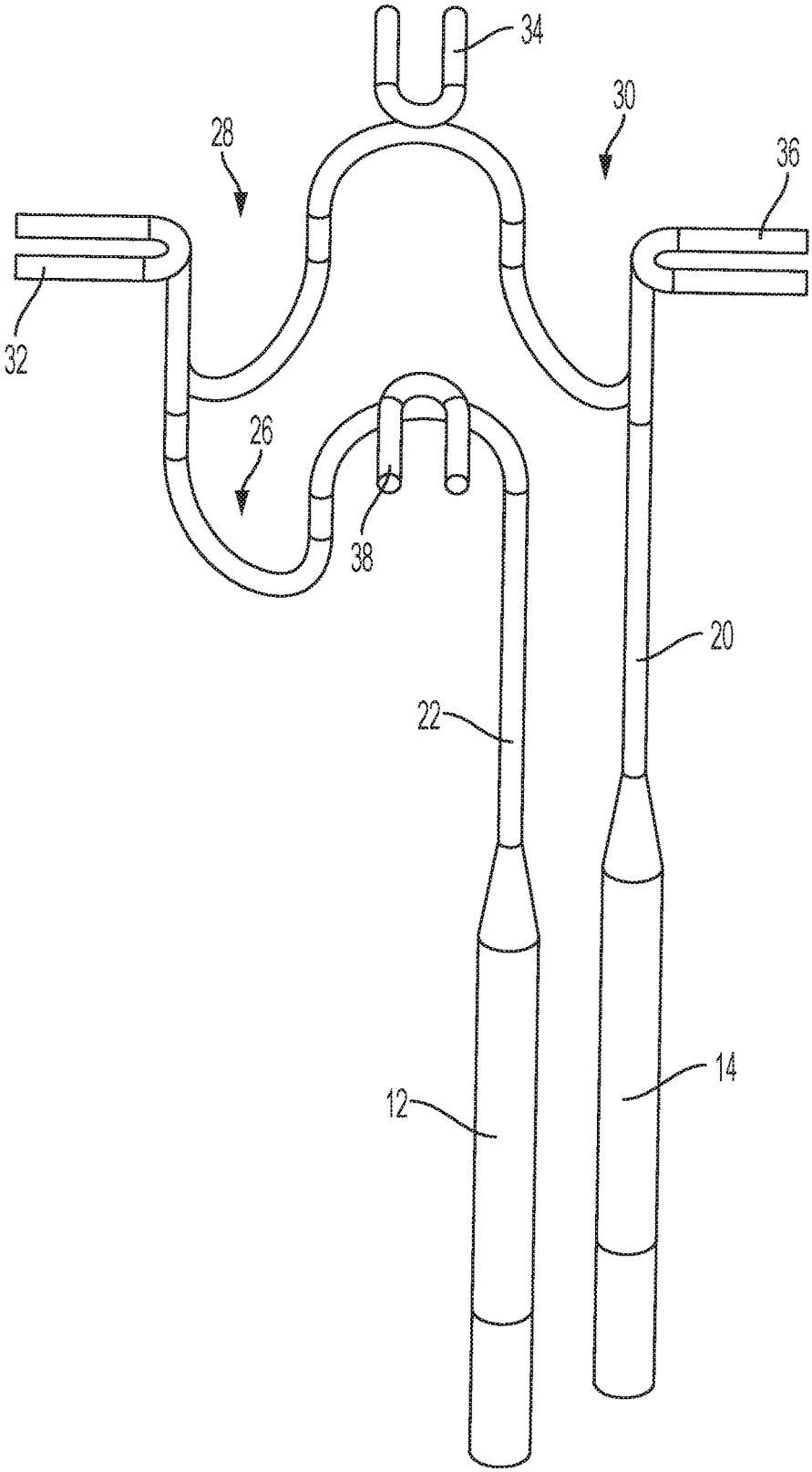
FIG. 3*a* shows a perspective view of a changed embodiment of the heating element.

A further modified embodiment of the invention is apparent from FIG. 3*a*. There, the transition areas are configured as support sections 32, 34, 36 and 38 which extend exclusively at the top of the heating element. Every metal element is, in turn, bent in the shape of a U wherein the direction of extension of the open Us is radially towards the outside such that the metal elements extend horizontally.

With this solution, the heating element loops 26, 28, 30 are carried in a hanging fashion by the support sections 32 to 38 adjacent to one another, respectively. In addition, the vertical legs 20 and 22 of the heating element 10 are carried by the adjacent support sections 36 and 38 and supported by the thickened regions 12 and 14.

Figure 3B:
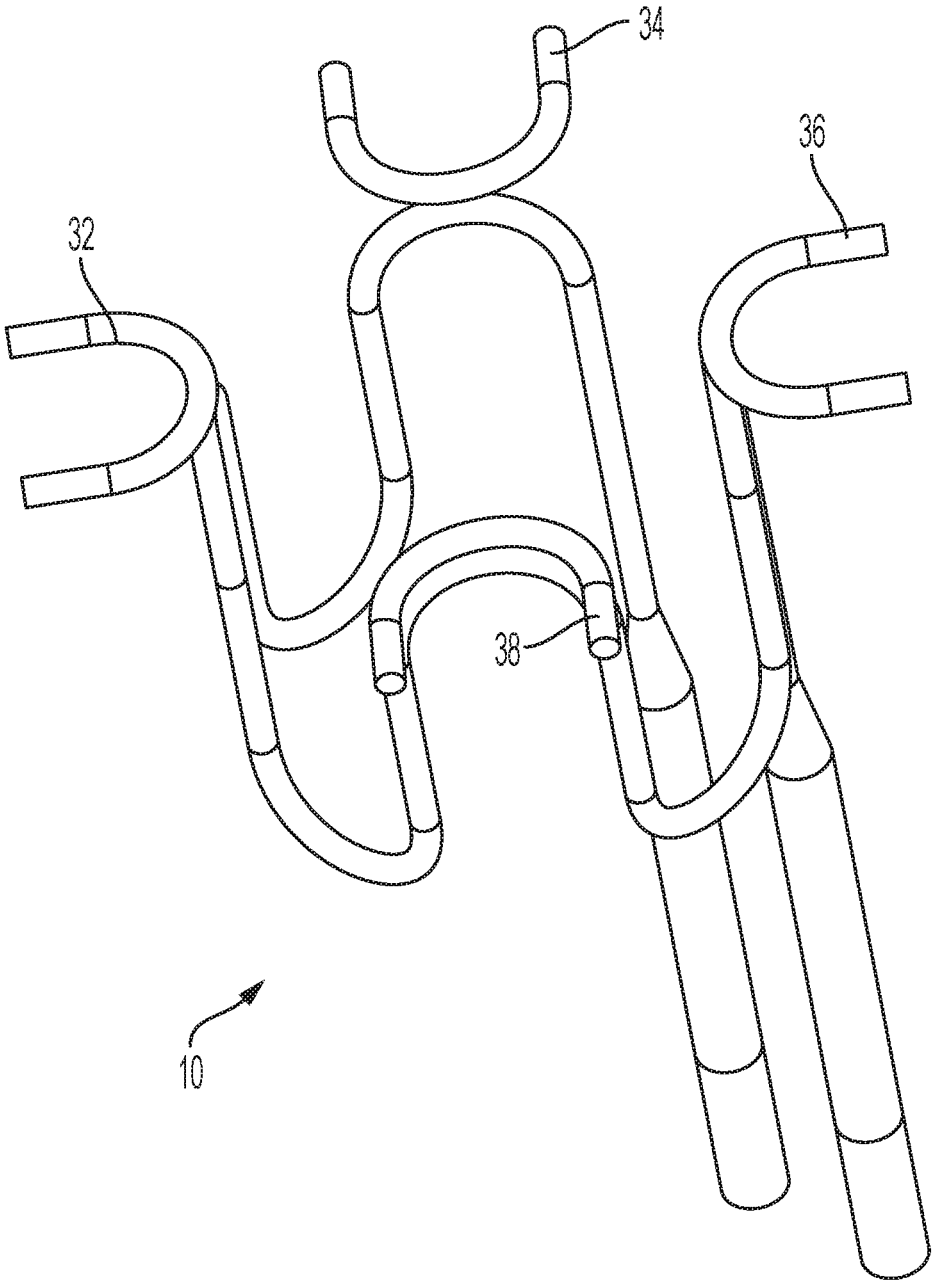
FIG. 3*b* shows an even more changed embodiment of the inventive heating element, also in a perspective implementation.

A further embodiment which is slightly modified with respect to the embodiment in FIG. 3*a* is apparent from FIG. 3*b*. Here, the U-shaped support sections 32 and 34 are wider, but extend in turn radially towards the outside and horizontally.

Figure 4A:
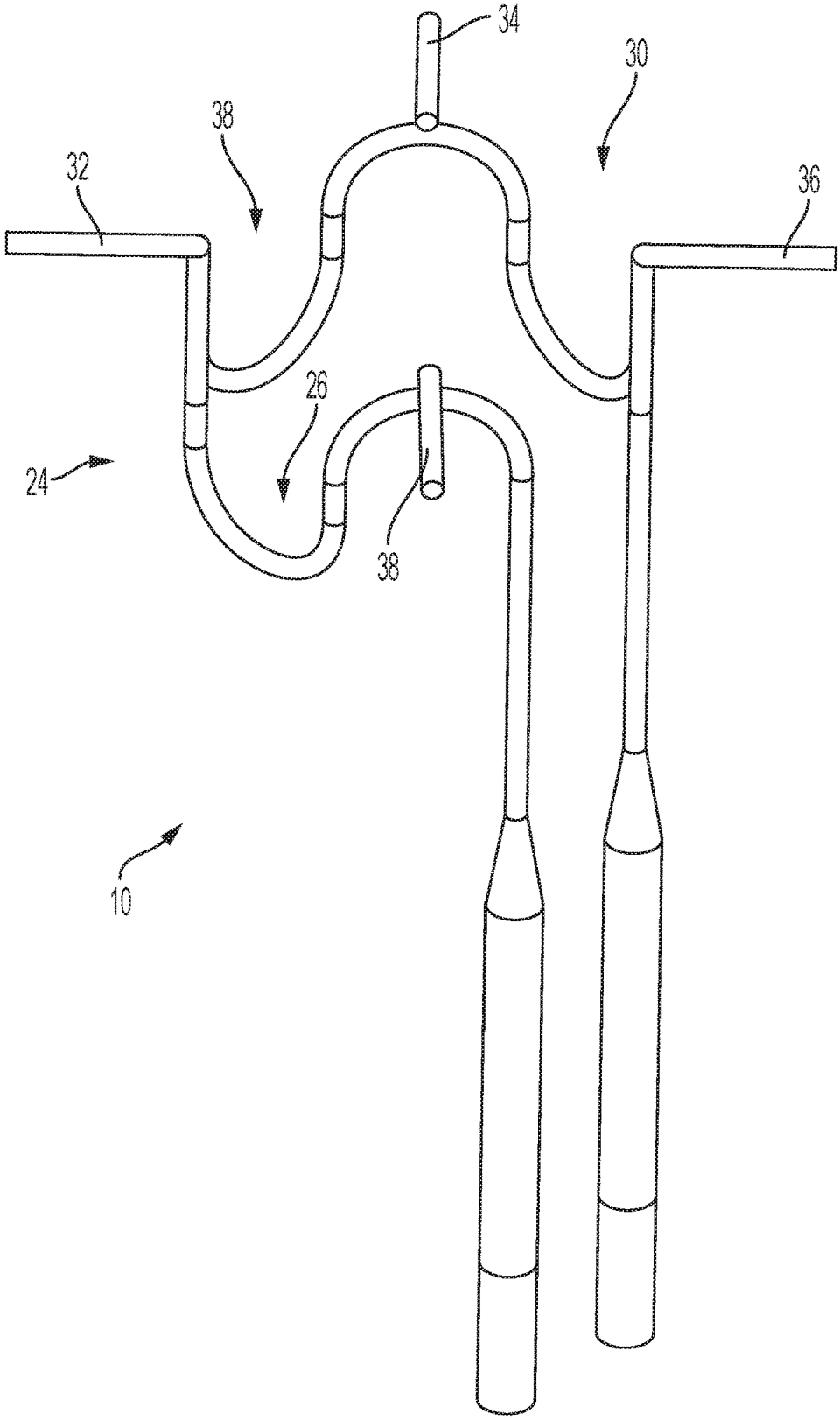
FIG. 4*a* shows a perspective view of a changed embodiment of the heating element.

A further modified configuration of the inventive heating element 10 is apparent from FIG. 4*a*. With this solution, the support sections 32, 34, 36 and 38 are configured as bars each which extend radially towards the outside to form the cold ends and which are each welded to the respective heating element loops at the top. Here, too, the support is realized in bores or recesses of the thermal insulation; the heating element loops 26, 28 and 30 are sagging starting therefrom to the bottom.

Figure 4B:
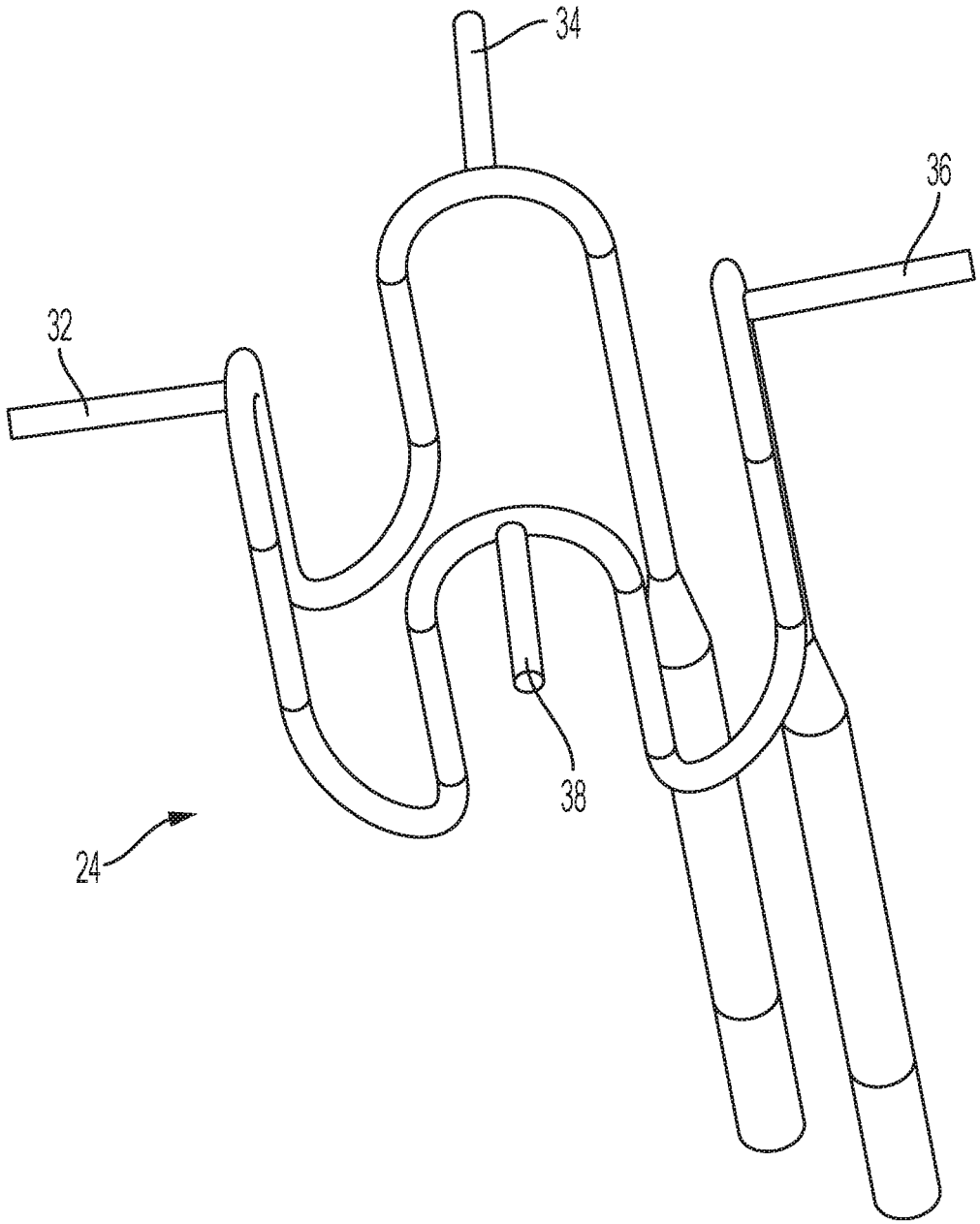
FIG. 4*b* shows an even more changed embodiment of the inventive heating element, also in a perspective implementation.

The embodiment according to FIG. 4*a* is apparent in FIG. 4*b* in a slightly modified fashion in another perspective and in another illustration. In this embodiment, the cold ends or support sections 32 to 38 are slightly longer and accordingly slightly colder than in FIG. 4*a*.

Figure 5:
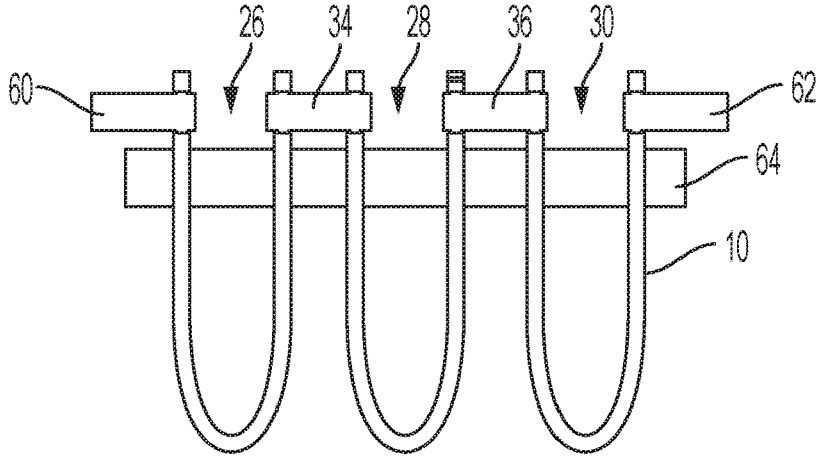
FIG. 5 shows a side view of a further embodiment of an inventive heating element.
Figure 6:
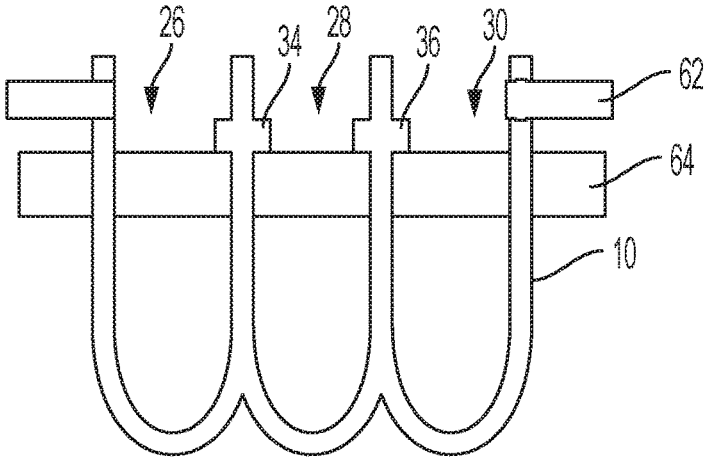
FIG. 6 shows a side view of a further embodiment of an inventive heating element.
Figure 7:
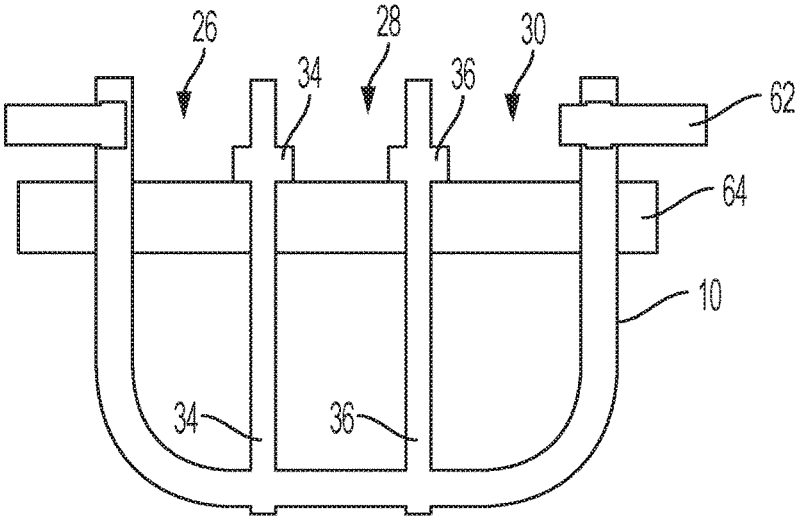
FIG. 7 shows a side view of a further embodiment of an inventive heating element.

A further embodiment of an inventive heating element is apparent from FIG. 5. The embodiments according to FIGS. 5 to 7 are illustrated in an unrolled fashion, which means that they extend circularly in principle but that they are illustrated in a linear fashion here.

It is to be understood that in case of other embodiments of the inventive heating element a linear configuration may be realized indeed which may comprise a substantially larger number of transition areas and heating element loops, by all means.

In the configuration according to FIG. 5 heating element connections 60 and 62 are provided. They are supported on a thermal insulation layer 64. The heating element 10 passes through the thermal insulation layer 64, wherein three heating element loops 26, 28 and 30 are configured whose upper ends each in turn pass through the thermal insulation 64.

Two transition areas 34 and 36 are configured which extend on this side of the thermal insulation, as it were, and are cooler in this respect due to the larger cross-section of the lines.

In the configuration according to FIG. 6, electrical connections 60 and 62 are provided in turn which extend away from the heating element 10 laterally on this side of the thermal insulation. The transition areas 34 and 36 are also formed on this side of the thermal insulation 64, namely by a fastening element which is supported on the thermal insulation 64. The heating element loops 26 and 28 merge with one another on the other side of the transition area 34; likewise, this holds true for the heating element loops 28 and 30 with respect to the transition area 36.

In this embodiment, the flow of current does not pass through the transition areas 34 and 36 on this side of the thermal insulation 64 but only on the other side of the thermal insulation 64.

The flow of current forms a region providing for heat output, the heat handling region, in which the heating elements 10 extend or at least partially extend.

This also holds true for the configuration according to FIG. 7. Here, the transition areas are configured by support sections 34 and 36 whose cold free ends are supported on the thermal insulation 64 and welded to the heating element 10. This solution allows for a production that saves material and bends.

Figure 8:
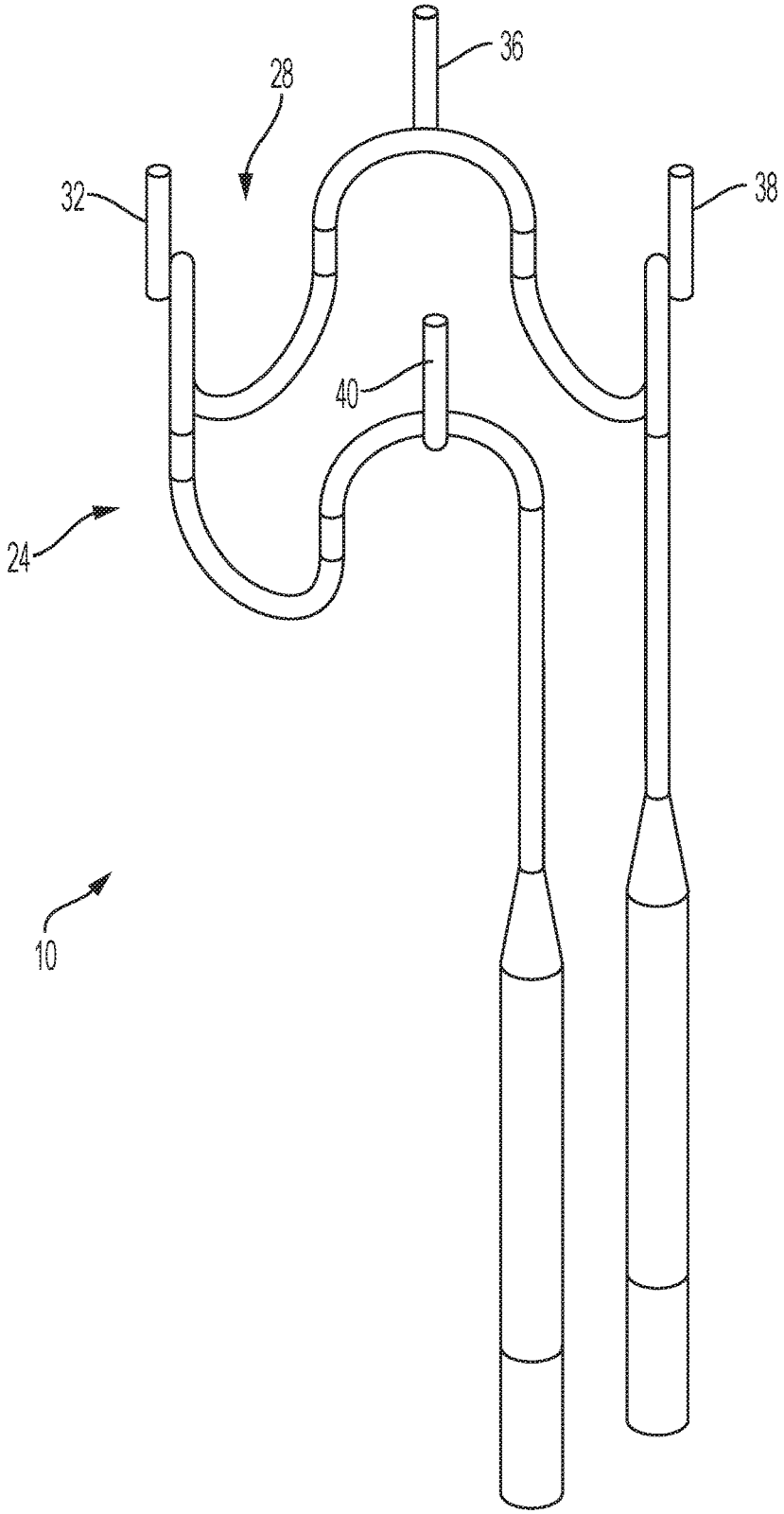
FIG. 8 shows a perspective view of an inventive heating element in a further implementation.

A further configuration of the invention is apparent from FIG. 8. In this solution, the cold ends or transition areas 34, 36, 38 and 40 extend vertically, wherein the respective heating element loops 26, 28 and 30 are suspended by way of this solution. For this purpose, the support sections 34 to 40 are clamped to the thermal insulation.

Figure 9:
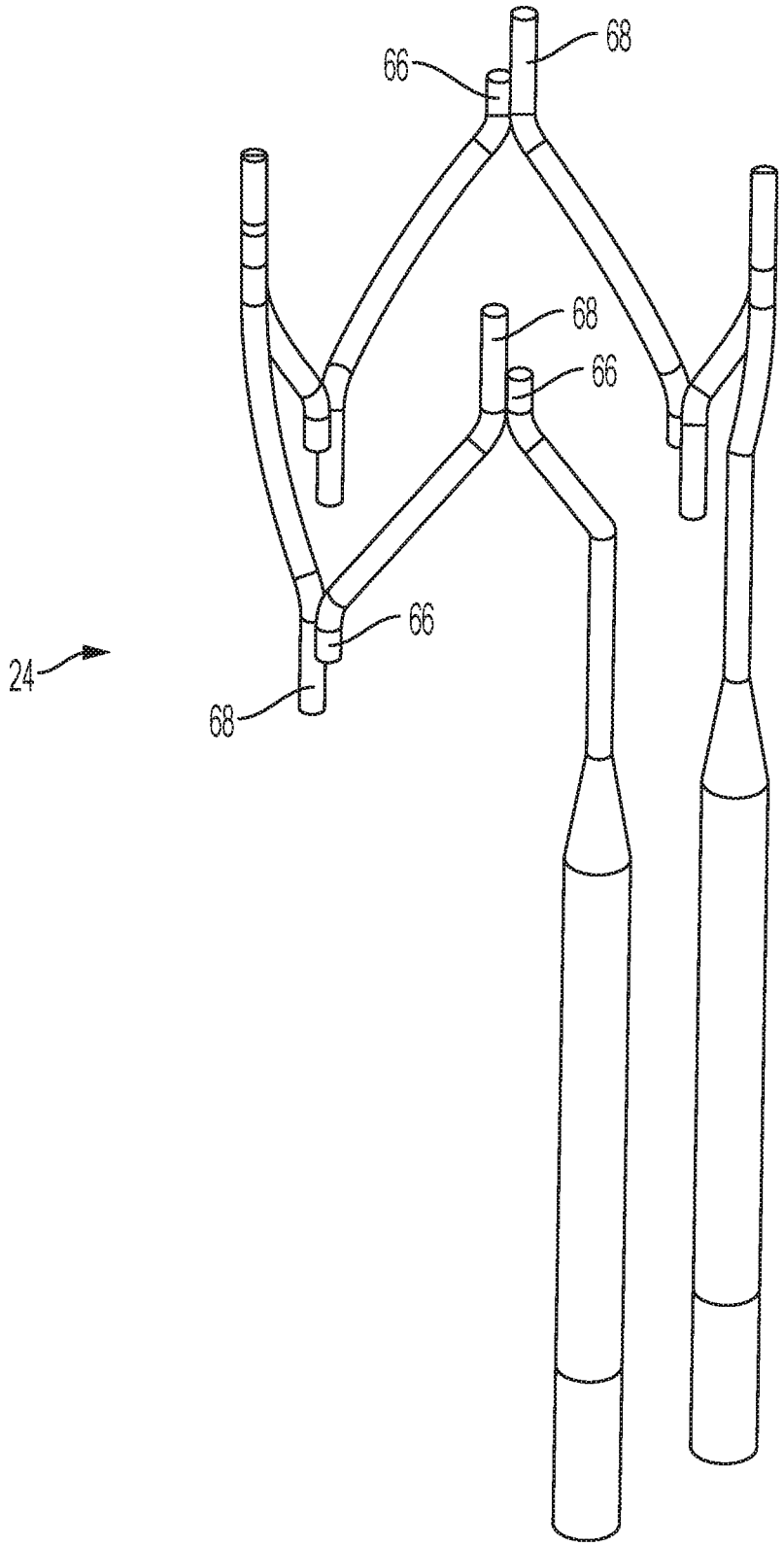
FIG. 9 shows a further embodiment of an inventive heating element.

A solution with equal parts is apparent from FIG. 9 which may be produced relatively cost-effectively accordingly. The equal parts are welded to one another wherein a short cold end 66 is combined with a long cold end 68 at every transition area, which are welded to one another along the length of the short cold end 66.

Then, the long cold ends 68 are each received in recesses of the thermal insulation 64 such that the heating element is supported thereon.

Figure 10:
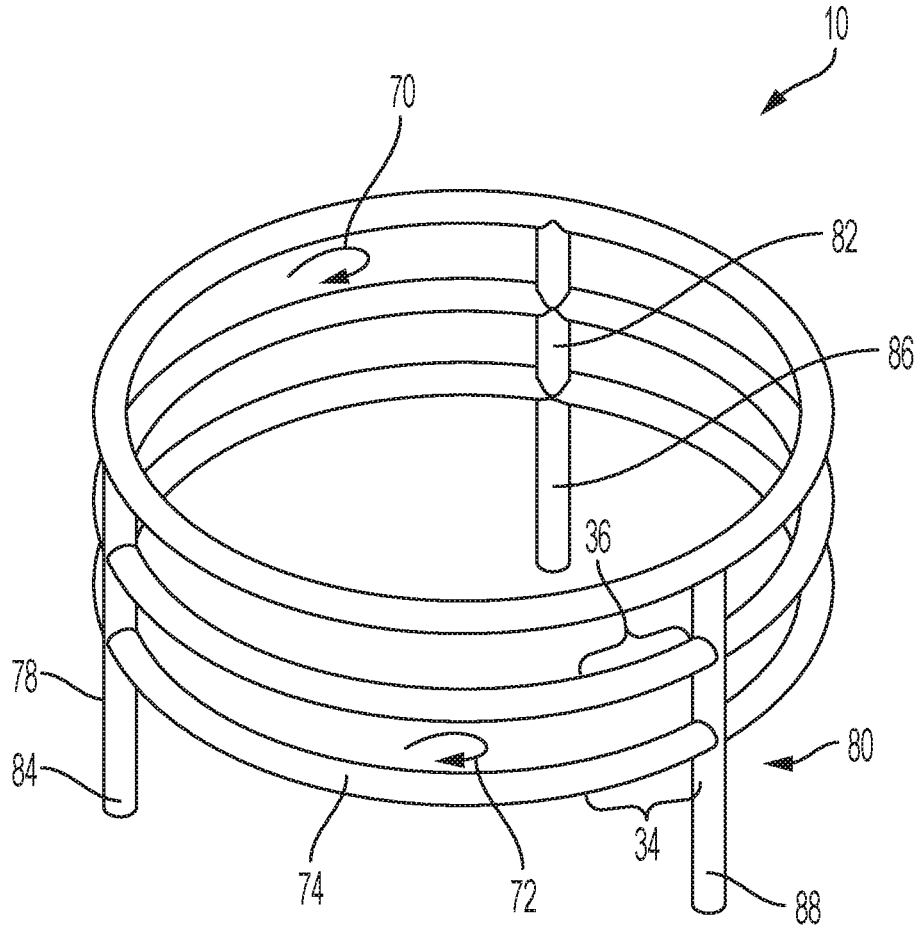
FIG. 10 shows a further embodiment of an inventive heating element.

FIG. 10 shows a further embodiment of an inventive heating element 10.

An induction heating process is realized in this embodiment. For this purpose, the heating element comprises closed electric circuits of which the electric circuits 70 and 72 are designated in FIG. 10. An electromagnetic alternating field induces currents in the electric circuits of the heating element 10 in a way known per se. They and their internal resistance lead to a drop in voltage, i.e. power loss, respectively, which is used as heating energy. In this respect, here, too, the heating element is a resistance heating element.

Horizontal legs 74 and 76 of the heating element 10 belong to the electric circuits. By heating, they lose part of their strength such that they sag in the hot state.

They are suspended on posts 78, 80 and 82. Their lower support sections 84, 86 and 88 do not carry a current such that they remain cold and strong, and at the same time cool surrounding regions of the electric circuits 70, 72, the transition areas 34, 36, and slightly increase the strength thereat.

These support sections are mounted in or on the thermal insulation of the furnace not illustrated herein.

It is to be understood that it is possible to form any desired other electric circuits without leaving the scope of the invention. In this way, particularly with the inductive heating, the horizontal legs may be configured to be shorter than the vertical legs in order to further reduce sagging. It is also possible to realize a hanging support at the posts 78, 80, 82.

Alternatively, with the inductive configuration of the heating it is also possible to use a considerably higher number of support sections and/or also lateral support sections, that means support sections which extend transversely to the current-carrying sections of the heating element, namely horizontally or transversely to the top or bottom.

Free ends of support sections of this type are each mounted in or on the thermal insulation, too.

The invention claimed is:

1. A dental furnace comprising a heating element arrangement (10) which is intended to give off heating energy to the firing chamber, wherein the heating element arrangement (10) has at least a first electrical connection (16) and a second electrical connection (18), each at least first and second electrical connections connected to a configuration of current-carrying heating elements, wherein the at least first and second electrical connections (16) (18) are supported on the dental furnace outside of the firing chamber, wherein the configuration of current-carrying heating elements is adjoined to a transition area element (34) which does not carry a current and/or which extends away from the configuration of current-carrying heating elements.

2. The dental furnace as claimed in claim 1 wherein the transition area element (34) supports the configuration of current-carrying heating elements at least two adjoining heating element sections (48, 50) of the configuration of current-carrying heating elements, and wherein the transition area element (34) comprises a free end supported on the dental furnace.

3. The dental furnace as claimed in claim 1, wherein the transition area element (34) comprises a plurality of transition area elements (32, 34, 36, 38, 40), wherein every heating element section (48, 50) of the configuration of current-carrying heating elements is suspended or supported on one end by one of the at least first and second electrical connections (16) (18) and on a second end by one of the plurality of the transition area elements (32, 34, 36, 38, 40).

4. The dental furnace as claimed in claim 1, wherein a free end of the transition area element penetrates into the thermal insulation (64) and wherein the electrical connections (16, 18) are disposed beyond the thermal insulation (64) on a side opposite from the firing chamber and from the heating elements.

5. The dental furnace as claimed in claim 1, wherein the transition area element (34) divides the configuration of current-carrying heating elements into the heating element sections (48, 50).

6. The dental furnace as claimed in claim 1, comprising a plurality of transition area elements (32, 34, 36, 38, 40) disposed at a plurality of locations on the configuration of current-carrying heating elements.

7. The dental furnace as claimed in claim 1, comprising wherein the transition area element is fabricated as a single unit and is fabricated of metal.

8. The dental furnace as claimed in claim 1, wherein the transition area element is welded to the configuration of current-carrying heating elements, wherein the transition area element is mounted in or on thermal insulation, wherein the configuration of current-carrying heating elements extend from the thermal insulation on a side opposite the transition area element.

9. The dental furnace as claimed in claim 1, wherein the configuration of current-carrying heating elements extend from a bottom side of thermal insulation (64) in a way such that the thermal insulation (64) forms a support for the transition area element on a top side of the thermal insulation (64).

10. The dental furnace as claimed in claim 1, wherein the dental furnace heats the configuration of current-carrying heating elements to an element temperature of 1850° C.

11. The dental furnace as claimed in claim 1, wherein the dental furnace comprises thermal insulation (64) on which the transition area element (34) is supported or with which the transition area element is in contact, wherein the thermal insulation (34) cools and stabilizes the configuration of current-carrying heating elements by thermal contact and thermal conduction through the transition area element.

12. The dental furnace as claimed in claim 1, wherein the configuration of current-carrying heating elements comprises an oxide layer having thermomechanical properties, and wherein the transition area element comprises an oxide layer having thermomechanical properties which are more resilient then the thermomechanical properties of the oxide layer of the current-carrying elements.

13. The dental furnace as claimed in claim 1, wherein, adjacent to the transition area element, the largest temperature gradient in the configuration of current carrying heating elements is present, as viewed along a path that carries current.

14. The dental furnace as claimed in claim 1, wherein the configuration of current-carrying heating elements comprises molybdenum disilicide, and wherein the dental furnace heats the molybdenum disilicide to a temperature at which a mechanical tensile strength of the molybdenum disilicide is reduced to less than half of the tensile strength of molybdenum at room temperature.

15. The dental furnace as claimed in claim 14, wherein the tensile strength is reduced to a strength of less than 100 MPa at a temperature of 1600° C.

16. The dental furnace as claimed in claim 1, wherein the configuration of current-carrying heating elements is configured as an induction heating element, and wherein the transition area element supports and holds the configuration of current-carrying heating elements by metallic contact.

17. The dental furnace as claimed in claim 1, wherein the configuration of current-carrying heating elements is not in contact with the thermal insulation (64) and other parts of the furnace, and wherein the transition area element which contacts the thermal insulation (64) is mounted movably on the thermal insulation in order to compensate for temperature-related changes in size of the configuration of current-carrying heating elements.

18. The dental furnace as claimed in claim 1, wherein the transition area element is U-shaped, T-shaped, L-shaped, bar shaped, rod-shaped, closed or open circular, closed or open oval-, closed or open squaree, or closed or open rectangular-shaped.

19. The dental furnace as claimed in claim 1, wherein the transition area element is fabricated of metal, metal alloys, ceramic materials, metal-ceramic materials (eg., MoSi) or a mixture thereof.

20. A process for operating a dental furnace comprising a heating element arrangement (10) which comprises molybdenum disilicide, said process comprising subjecting the heating element arrangement (10) to regeneration firing at 1300-1800° C., wherein in the regeneration firing process the dental furnace is brought to an oxidation temperature of the molybdenum disilicide without the placement of dental restoration parts.

21. The process as claimed in claim 20, wherein the heating element arrangement comprises a configuration of current-carrying heating elements adjoined to a transition area element, wherein no current flows through the transition area element, wherein the transition area element extends transversely to and away from the configuration of current-carrying heating elements, and wherein the transition area element is supported on the dental furnace.

* * * * *